United States Patent [19]

Rail et al.

[11] 4,266,889

[45] May 12, 1981

[54] SYSTEM FOR PLACING FRESHLY MIXED CONCRETE ON THE SEAFLOOR

[75] Inventors: Robert D. Rail, Ojai; Harvey H. Haynes, Camarillo, both of Calif.

[73] Assignee: The United States of America as represented by the Secretary of the Navy, Washington, D.C.

[21] Appl. No.: 96,852

[22] Filed: Nov. 23, 1979

[51] Int. Cl.[3] ..... E02D 15/06

[52] U.S. Cl. ..... 405/223; 405/303

[58] Field of Search ..... 405/155, 195, 222, 223, 405/224, 225, 233, 269, 303; 264/31

[56] References Cited

U.S. PATENT DOCUMENTS

| | | | |
|---|---|---|---|
| 1,256,074 | 2/1918 | Taft | 405/223 |
| 2,780,920 | 2/1957 | Silvert | 405/223 |
| 2,986,889 | 6/1961 | Ludwig | 405/224 |
| 3,688,510 | 9/1972 | Keating | 405/303 |
| 3,791,153 | 2/1974 | Inoue et al. | 405/223 |
| 3,861,157 | 1/1975 | Hillen | 405/223 |
| 4,129,008 | 12/1978 | Nakahara et al. | 405/303 |

*Primary Examiner*—David H. Corbin

*Attorney, Agent, or Firm*—Richard S. Sciascia; Joseph M. St.Amand

[57] ABSTRACT

A means for placing freshly mixed concrete on the ocean floor at great depths. A pipeline is grossly positioned by a ship whereas the position of the submerged end is controlled by guide wires, water jets, props, etc. The discharge device at the end of the pipeline includes a slip joint, a tank flooded with seawater to maintain the pipe end submerged a certain distance in the concrete, and an expansion chamber where the velocity of the concrete being discharged is reduced. Deflector means at the pipe end directs the concrete laterally and negates the vertical lift component of the discharging concrete.

14 Claims, 4 Drawing Figures

SYSTEM FOR PLACING FRESHLY MIXED CONCRETE ON THE SEAFLOOR

BACKGROUND OF THE INVENTION

This invention relates to a system and means for placing concrete on the ocean floor at great depths.

Applications for placing concrete in the deep ocean are basically in three areas: in situ construction of anchors and foundations for fixed ocean facilities, in situ hardening of structures or objects on the seafloor, and containment of hazardous or polluting substances for environmental protection. Such applications require portland cement concrete to be placed underwater in quantities of hundreds and thousands of cubic yards in water depths as great as 20,000 feet.

Presently available prior art methods for placing concrete on the seafloor only provide the following capabilities: concrete can be placed on the seafloor or in open forms in water depths to about 400 feet; grouts, which are cement slurries or cement-sand slurries, can be placed underwater in open forms to similar depths; also grouts can be placed underwater at much greater depths, thousands of feed, but only if placed in confined spaces where the flow can be controlled by back pressure, as in an oil well. In general, for most structural applications concrete is superior to grout and costs less. Concrete, which contains larger aggregates than grout, has better structural properties, is heavier and in some cases can be placed without forms which would result in major cost savings.

The most practical way to provide for large holding capacities on the order of 2 to 20 million pounds for fixed ocean facilities in most deep ocean seafloors is to use very large deadweight anchors. In certain hard seafloors, large anchor forces may be best provided by clusters or piles drilled into the bottom and connected together with large pile caps.

A 20 million pound capacity deadweight concrete anchor would have a submerged weight of about 40 million pounds and thus be about 160 feet in diameter by 20 feet thick. This is comparable to the quantity of concrete in a large building mat foundation or a bridge pier but is small compared to a concrete offshore oil platform or a deadweight anchorage for a suspension bridge cable.

Prior methods do not exist for the deployment of large deadweight anchors since the loads are beyond the capacity of existing heavy lift equipment. A number of drill ships exist that can lift about one million pounds in deep water, and a few crane barges are available rated at 6 million pounds for surface or shallow water lifts. One ship in the world, the Glomar Explorer, has had the capability to lift a design load of 8 million pounds from a depth of 17,000 feet. Two or three other recently developed mining ships have deep water lift capacities greater than the drill ships' but much less than the Glomar Explorer's. Outfitting barges or mining ships or re-outfitting the Glomar Explorer for multi-million pound anchor deployment would be very expensive.

A method has been proposed for free-fall emplacement of large deadweight anchors in deep water where seafloor site conditions are favorable. However, this method is designed for applications in which precise positioning is not critical, such as a single point deep ocean mooring but is not appropriate for cases where more precise positioning is important, for example, placing an object at a predetermined seafloor position or placing objects in close proximity to each other. Free-falling is not an appropriate emplacement technique for all sites at which very large deadweight anchors would be used but only for those sites with a soft seafloor at a fairly flat slope.

An alternative to lowering or free-falling a massive anchor is a combination of pre-fabrication and in-situ placement of the present invention as hereinafter described below.

If an object of strategic significance is lost on the seafloor, a decision to salvage the object could be expensive, particularly if the object is lost in deep water and is very large, such as a ship or craft that is too heavy to lift in toto.

Concrete placement makes another option available for consideration. Rather than salvaging the object it can be encapsulated in place on the seafloor by covering it with concrete (FIG. 1). The purpose is to sequester the object in such a way as to deny observation, access or removal of portions of it by others. The operational cost savings for encasing a ship-sized object is substantial compared to a recovery operation.

For many smaller-sized objects, in situ hardening has application where concrete encasement is faster and costs less than recovery.

Another application of hardening is the stabilization of ocean cables and pipelines on firm seafloors in deep water. The purpose is to prevent accidental damage which is caused mostly by trawlers and, importantly, to preclude purposeful damage. At the present time, cables and pipes are protected by burial in those seabottoms soft enough to be trenched. In bottoms not suitable for trenching other protective methods are needed. In some cases, pre-cast concrete covers have been placed over seafloor cables to stabilize them on a firm bottom.

Still another application of placing concrete on the seafloor is to cover or contain hazardous substances for the purpose of isolating them from the environment. Again, this is an alternative to recovery. A hazardous material incident could involve radioactive materials from a nuclear power source. Another example is containment of hazardous materials dumped in the ocean in the past and presenting a potential problem in the present. Leakage problems if they arose could be resolved in many instances by encasement in concrete.

A number of state-of-the-art methods exist for transporting concrete and similar materials by pipeline and for placing them underwater as are discussed briefly, below.

Tremie Method: The construction industry regularly places large quantities of concrete underwater by tremie methods at depths of tens of feet to one or two hundred feet in protected waters for bridge piers and other waterfront type structures. Concrete falls by gravity through open pipes and is placed in forms or confined space. Flow rate is controlled by depth of burial of the lower end of the tremie in the concrete. Good quality concrete is regularly produced using established mix designs and operating procedures. Maximum depth of placement underwater to date is about 400 feet. Major limitations on going deeper are difficulties in starting the flow and maintaining control of the flow without runaway of the high slump concrete in the typically 12-inch or greater diameter pipe. Special approaches have been tried such as foot valves and pipe-within-pipe methods but these do not promise an order-of-magnitude increase in depth capability without considerable development of relatively complex methods. Also, the total weight of tremie pipes filled with concrete becomes very great with increasing depths.

Bucket Method: Large and small quantities of concrete have been successfully placed underwater by covered, bottom-opening buckets of up to several cubic yard capacity. Bucket-placement is used primarily in relatively shallow water although depth is restricted more by operational considerations than by technical limitations. Stiffer concrete, with larger aggregate (up to several inches diameter), can be placed by bucket than by tremie. Specially designed bucket methods have been proposed that would be suitable for placing small but not large quantities of concrete in the deep ocean.

Concrete Pumping: Pumping concrete through pipelines of 2-inch to 8-inch diameter is a well-established practice on land or horizontal distances of 1,000 feet or greater and vertical distances of several hundred feet upward. Reliable equipment and experienced operators are available; mix design is well known to produce pumpable, good quality concrete. Difficulties that do occur are usually due to not following standard procedures, for example, attempting to save costs by using borderline materials, equipment or practices, or are due to operational delays.

Pumping downhill is often troublesome and is not frequently done. However, in some instances, concrete has been pumped down for placement underwater in water depths to about 200 feet. In pumping downhill, it is important to avoid the formation of air pockets and voids in the pipeline. Both large air bubbles and voids can disrupt the flow and cause segregation of the mix which in turn causes blockage of the pipeline. A bleed valve at the high point at the pipeline is used to vent air during initial filling of the pipe with concrete, after which the valve is closed. Flow is then maintained under continuous positive pressure to prevent formation of voids.

Pumping methods offer the potential for an order-of-magnitude increase in water depths at which concrete can be placed provided that means are used to maintain a positive pressure continuously throughout the fully-filled pipe and to control the flow rate, and the characteristics of the fresh concrete required for the controlled flow in the pipeline is compatible with the concrete characteristics required after the concrete is discharged from the pipe at the seafloor. The placement method discussed herein uses a closed system, pumping approach.

Pumping Grouts and Mortars: Grouts is a mixture of either cement and water (neat cement grout) or cement, water, and sand (sand grout), both having a fluid consistency. Mortar is a mixture of cement, water, and sand usually of a stiffer consistency than grout. Grouts and mortars often contain admixtures to control setting, minimize bleeding, or otherwise affect the material characteristics. Grouts and many mortars are readily pumped.

Grouts are regularly pumped through small (e.g., 1-inch) diameter pipes and placed in confined spaces for many construction applications, such as repair of concrete, encasement of post-tensioning tendons, and construction of water cut-off curtains under dams.

Grout pumping is also used for underwater concreting by the preplaced aggregate method by which large quantities of concrete have been successfully placed to depths greater than 100 feet for construction of large bridge piers and other purposes. The coarse aggregate is placed in forms and then intruded with a fluid grout through pre-positioned grout pipes. This method might be adapted to deep ocean placement but probably would require a complex operation since separate placement system would be needed for the forms, the aggregate and the grout. Such a method would be limited to applications using forms or other confined space.

Large quantities of grout, on the order of 10,000 cubic yards, have been placed under offshore gravity-type structures located in water depths to 450 feet. The purpose is to provide uniform bearing on the seafloor and to minimize settlement, especially differential settlement. Grouts used for this purpose develop low strengths and are placed in confined chambers.

Probably the largest deep placement operation was one in which more than 1,300,000 cubic yards of ⅜-inch maximum size aggregate mortar were pumped downward about 1,000 feet into a large water-filled cavity under a dam. The purpose was to fill an enclosed void. Structural grade concrete was not required.

Cementing Oil Wells: Sophisticated above-ground and down-hole equipment, materials and procedures have been developed to cement oil wells to depths of 20,000 feet or more under conditions of high pressure and high temperature. Practices are limited to placing cement slurries in confined holes using the back pressure of the drilling fluid to control flow. Concrete is not used. Cement slurries are typically water, cement and various specialized admixtures. For certain purposes, such as increasing the unit weight of the grout, fine sand is sometimes used. The maximum sand grain size that can be accommodated by pumps and down-hole equipment is about ⅛-inch diameter. Sand, when used, is typically smaller than number 20 size; i.e., about 1/30-inch in diameter.

Well cementing methods have been adapted to some offshore platform construction: grouting platform pin-piles to the seafloor and grouting in anchor piles. On one occasion a number of bell-bottomed reinforced concrete piles of 3½-foot diameter belled out to 9- to 15-feet diameter at the bottom end were constructed in a total depth of about 500 feet. A grout with maximum sand size of 1/30th of an inch was pumped into a drilled hole (which contained the steel reinforcing cage) to displace a weighted mud slurry.

Combined theoretical and empirical methods are used to predict the flow behavior in a pipeline of cement slurry treated as a non-Newtonian fluid. Flow calculations utilize experimentally determined coefficients related to slurry viscosity in laminar flow. This method is not directly applicable to plug flow of concrete in a pipe.

The major aspect of construction grouting and oil well cementing technology that is adaptable to deep ocean concrete placement is the control of material properties, particularly prevention of water loss from grouts and slurries under high pressures and pressure differentials. These properties are controlled primarily by careful selection of materials, control of mix proportions, control of procedures and use of specialized admixtures. Pumps and other equipment for grouting and cementing are not adaptable for concreting.

Mine Construction: Concrete for shaft and tunnel lining and other underground construction has been transported to the deep depths by dropping the freshly mixed concrete down long vertical pipes. Copper mines in the U.S. and gold mines in South Africa have shafts that are several thousand feed deep. The concrete segregates during the fall and is usually remixed at the bottom before being placed. This method is not applicable to underwater placement.

Slurry Transport: Particulate matter such as coal is transported long distances in "slurry pipelines." Similarly, spoil from hydraulic dredges and many materials in processing plants are transported in pipelines by two-phase flow with the suspended solid particles propelled by the drag forces of the faster moving water or other fluid. Usually turbulent flow is maintained to prevent particles from settling out. This technology is not applicable to pipeline transport of concrete.

SUMMARY OF THE INVENTION

This invention provides the capability to place large quantities of concrete to deep ocean depths not presently available in a practical (economic) manner by prior art methods. Massive anchors, foundation slabs, or structures can be built in situ of high quality concrete. Operations, such as encasement of hazardous materials on the seafloor, can be conducted as an alternative to recovering the hazardous materials.

For encasement application, concrete has a distinct advantage over grout because concrete can "stand" under self weight higher than the slurry mixtures. The large aggregate in concrete provides this capability. Thus, formwork to contain the cemetatious materials will not be required. Also, for most structural applications concrete has better structural properties than grout, it is heavier and it costs less.

This inventtion can also be used to place cementatious materials such as concrete and grouts, and non-cementatious materials such as sand, gravel, iron ore, etc., on the seafloor.

The system comprises a means for placing concrete, freshly mixed, on the ocean floor at great depths. A pipeline is grossly positioned by a ship whereas the position of the submerged end is controlled by guide wires, water jets, props, etc. The discharge end of the pipe includes a slip joint, a tank flooded with seawater to maintain the pipe end submerged a certain distance in the concrete, and an expansion chamber which is used to reduce the velocity of the concrete mix at the discharge end. Deflector means at the discharge end directs the concrete laterally and negates the vertical lift component of the discharging concrete.

DESCRIPTION OF THE PREFERRED EMBODIMENT

Figure 1:
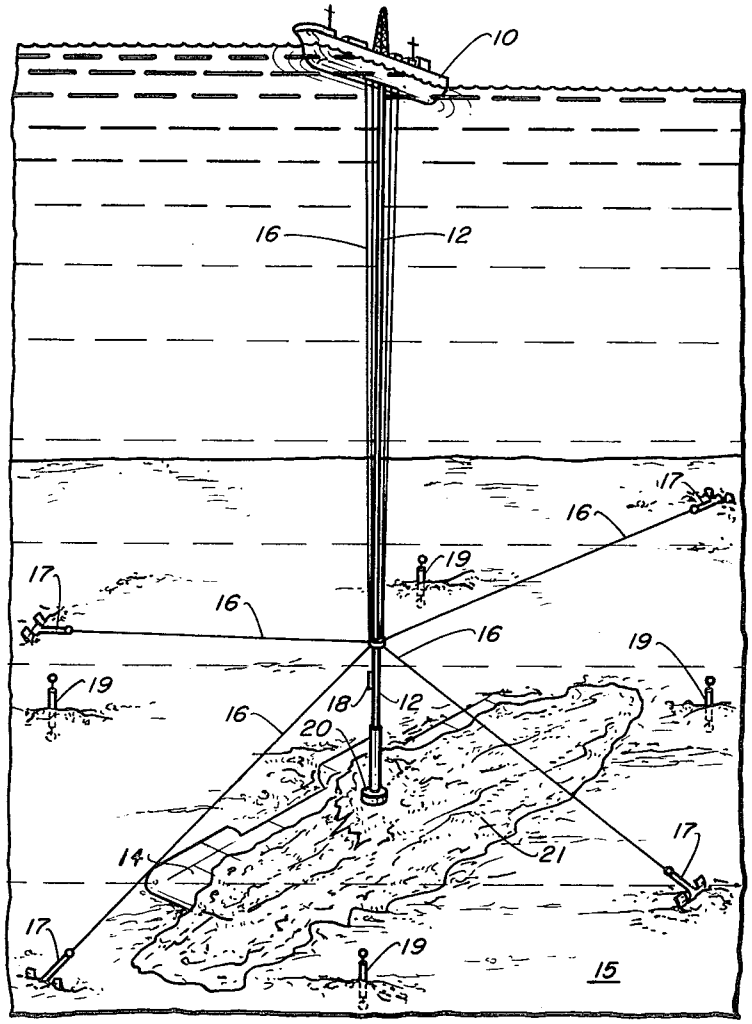
FIG. 1 shows a representative arrangement for a deep ocean concreting operation involving the present invention.

An overall representative arrangement for a deep ocean concrete placement operation is shown in FIG. 1. The surface platform 10 (e.g., a ship) is positioned at the site with the pipeline 12 deployed for concrete encasement of a large object 14 on the seafloor 15. The pipe handling mast (as shown) is located amidships over a moonpool. Pipe is stored horizontally on the ship's deck. The concrete batch plant, mixer and pump and the concrete materials storage bins are located on one or more decks; for large jobs additional materials storage would be on a barge alongside.

As shown in FIG. 1, a drill ship 10 has a pipeline 12 suspended therefrom. Dynamic positioning of the ship 10 controls the gross position keeping on the surface. Fine position of the bottom end of the pipeline 12 can be controlled by any one of a number of methods. In FIG. 1, a wire guide system 16 is used, shown being anchored at several points 17 to the seafloor. Alternative methods for fine position control include water jets, propellors, down-haul cables and other methods. The location of the bottom end is known by acoustic transponder systems 18 and 19, or other subsea navigation systems.

Figure 2:
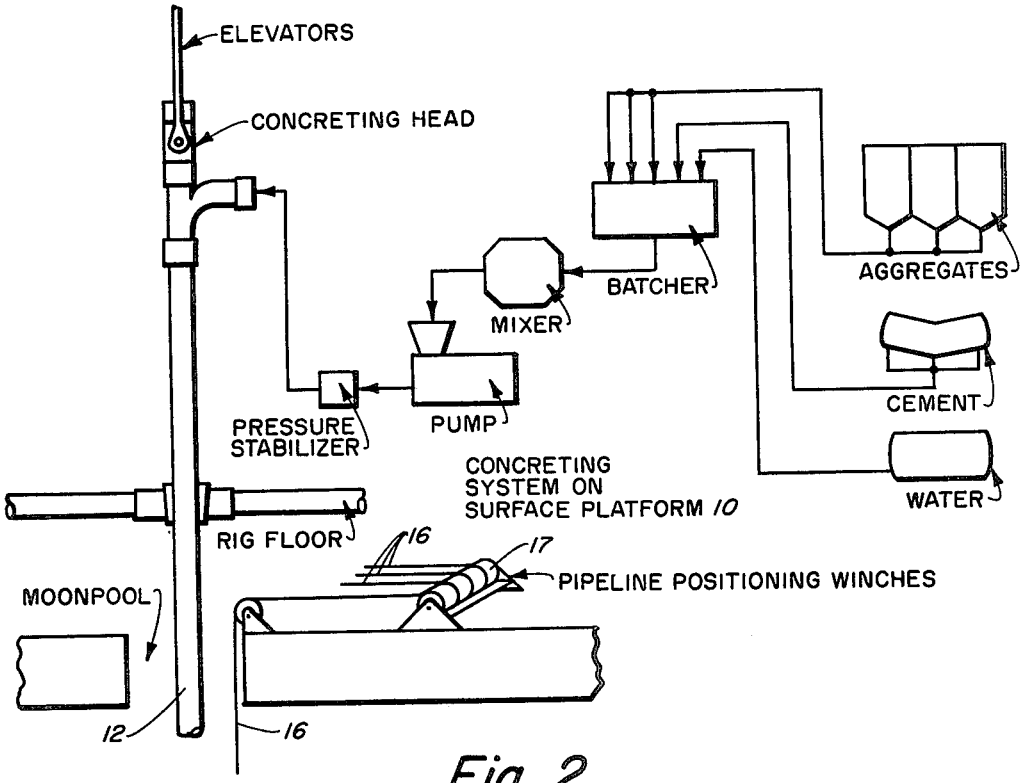
FIG. 2 is a schematic diagram of a concreting system on a surface platform.

Components of the concreting system are shown schematically in FIG. 2. Materials storage, conveying and batching equipment, and the concrete mixer and pump are conventional concreting equipment. The pipeline consists of standard oil well tubular goods. The pressure equalizer, the concreting head, and the seafloor discharge device are specifically built for deep ocean concreting operations.

Both position determination and position control systems are required at the surface and at the seafloor for the horizontal and vertical directions. The positioning and monitoring systems used for a given concreting operation will depend on the specific needs of that operation and on the capabilities of the drill ship 10 or other surface vessel.

The position determination system furnishes information on the horizontal and vertical location of three objects: the surface platform 10, the sub-sea object 14, and the lower end of the pipe string 12. These objects are located relative to each other and to some frame of reference such as geographic coordinates or a nearby taut buoy. Surface position determination systems indicate traditional navigational methods as well as more precise location systems such as satellite navigation, ship's radar, electronic distance measurement systems and horizontal angle measurement systems such as theodolites and lasers. Water column and seafloor navigation and position determination systems include short and long baseline acoustic transponder systems, load mounted sonar and TV, taut wireline to seafloor, and pipeline inclination measurement systems. Vertical positions may be determined by fathometer, load mounted sonic altimeter, and measurement of the length of pipe or wireline inside the pipe. Television is useful for target acquisition and initial approach to the seafloor as well as for post-operation observations, but may not be usable during concreting due to turbidity.

The primary function of the position control system is to place and maintain the discharge end of the pipeline at the desired horizontal and vertical position at the seafloor relative to the target location. Position will be controlled by a combination of maneuvering and station keeping of the surface ship for the gross position control, and the use of guidance devices (guidelines, posts, funnels, and cones) and subsea motive systems (attached near the lower end of the pipeline) for the local fine position control at the seafloor. Horizontal surface position is controlled by single or multiple point mooring systems in water depths to 2,000 feet or so, or by dynamic positioning to maintain the vessel at the desired surface position. Propeller and jet thrusters have been proposed for attachment to the lower portion of a pipe string for its horizontal position control near the seafloor. These methods have been found to be unnecessary in many cases in actual experience. Well hole reentry is usually performed by maneuvering the surface vessel and, once sonar or TV monitoring confirms alignment, stabbing the lower end of the pipeline into the seafloor guide funnel. Assembly of seafloor well heads is usually performed by maneuvering the surface vessel and the use of taut guidelines and guideposts.

Figure 3:
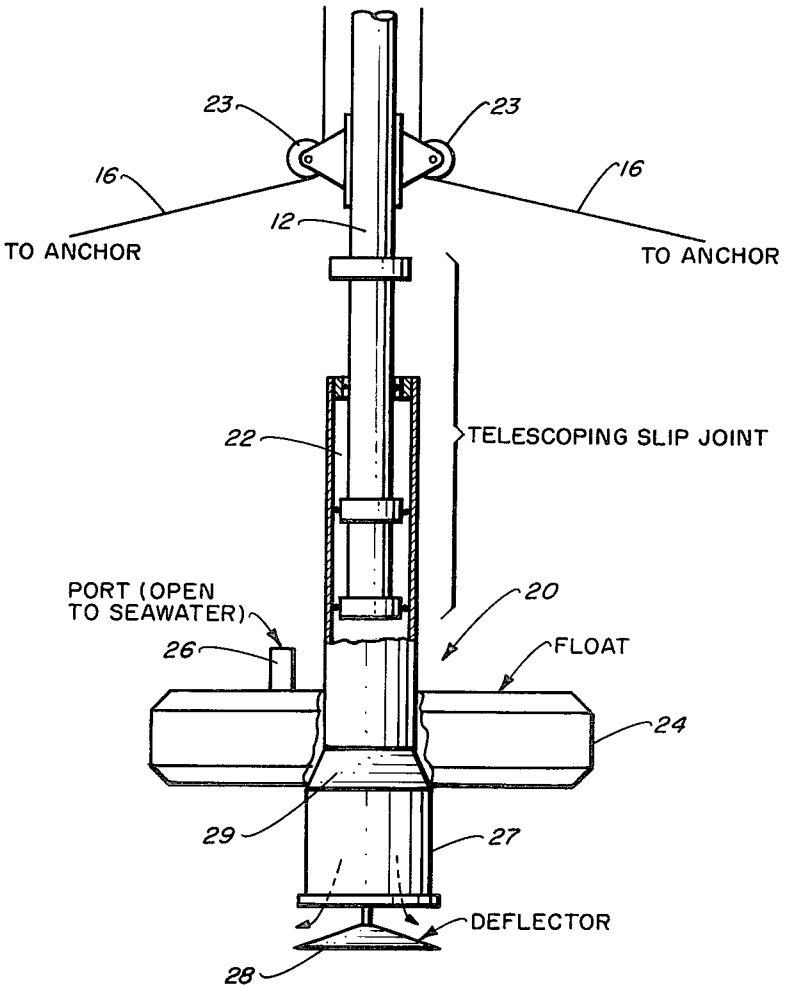
FIG. 3 is a cross-sectional view of the seafloor discharge device.

In the present case, multi-point mooring system 16 with taut lines to shipboard winches 17, as shown in FIGS. 1–3, can control the location of the bottom end of the pipeline 12 for accurate positioning and stabilization against random motions due to surface vessel excitation. This type of system has performed successfully to 3,000-feet water depths and is considered to be adaptable to deeper water.

Successful vertical position control (heave control) methods for pipe strings vary from manual adjustment to telescoping joints (bumper subs; riser slip joints) to various passive and active tensioners for guidelines and riser pipes and heave compensators in the pipestring hoisting system. Stabilized platforms such as column stabilized semi-submersibles are an appropriate solution.

For concrete placing by pipeline, vertical motion control is primarily needed to keep the lower end of the pipe buried in the concrete during discharge. The required vertical motion compensation can be obtained by the use of telescoping slip joints in the pipestring near the bottom just above the seafloor discharge device 20 which controls the placement of the concrete 21.

FIG. 3 is a cross-sectional view of the discharge device 20. The slip joint 22 decouples the discharge device 20 from the heave motion of the pipeline 12. Pulley wheels 23 are used to guide the taut lines 16 along pipeline 12 to the winches (FIG. 2).

Either specifically built slip joints or commercially available bumper subs can be used. For concreting with a 3-inch ID pipeline, for example, it is probably more economical to use one or more standard bumper subs (each with a 5-foot stroke) in series as is common practice in oil well drilling. For larger diameter pipelines, standard bumper studs are special order items so telescoping slip joints, as shown here in FIG. 3, would be more economical to build than bumper subs.

Tank 24, which is part of the discharge device, is flooded with seawater by means of a vent 26, for example, and stays on top of the concrete mound to maintain the open end of discharge pipe 27 at a predetermined submergence depth in the concrete mound 21. It is essential that the discharge pipe 27 stay submerged in the concrete mass if quality concrete is the desired end-product. A deflector 28 attached to the end of discharge pipe 27, as shown, directs the downward flowing concrete to a horizontal flow and negates the vertical lift component of the discharging concrete.

Concrete should be delivered to the pipeline smoothly and continuously and relatively free of pressure pulsations. A two-cylinder oil-hydraulic pump with a long stroke operating well below its maximum capacity can deliver concrete at a fairly constant pressure throughout a stroke and with a minimum of dead time between strokes. To further smooth out the pressure pulse, the pump can discharge into a pressure equalizing chamber and it, in turn, into the concerning head.

The concreting head (FIG. 2) provides a tightly sealed connection to the top end of the vertical pipeline and also provides a means for venting air, for inserting cleaning plugs, and for using a wire line, while maintaining pressure and flow of the concrete through the pipeline.

Seafloor Discharge Device: The function of the seafloor discharge system is to deliver the concrete underwater at the desired location in a coherent mass. Once flow has started, the concrete exit point is kept buried in the concrete already placed so that concrete is added to the interior of the mass. The mound grows by expansion in size from within rather than by addition of concrete on the surface of the mount. This procedure produces a compact mound with a minimum of washing out of cement or intermingling of concrete and seawater. The shape of the growing concrete mound is influenced by the properties of the concrete (such as slump), the discharge rate, the velocity of flow, and the depth of burial of the discharge point. The velocity is reduced in the expansion chamber portion 29, i.e., velocity dissipation chamber, of the discharge device. The depth of burial of the discharge point is maintained at about 5 to 7 feet. (If the discharge pipe is buried too deeply, the concrete spreads out in a flat shape; if not buried deeply enough, the concrete wells up around the pipe and spills out on the surface.)

The velocity dissipation chamber 29 has an increasing taper to prevent blockage by arching of aggregates. The tank-like "float" 24 rides on top of the concrete once the mound has grown to several feet in height and thus maintains the discharge point at a fixed depth of burial as the mound continues to grow. The telescoping slip joint 22 acts as a heave control device. The joint can accommodate 15 feet of more of vertical movement to decouple the discharge device from the pipeline movement.

Undersea construction applications will be of great importance in the future. The capability to construct and install very large anchors and large seafloor foundations and structures in deep water will be needed. Lowering or free-falling such foundations or massive anchors is impractical in many instances.

Figure 4:
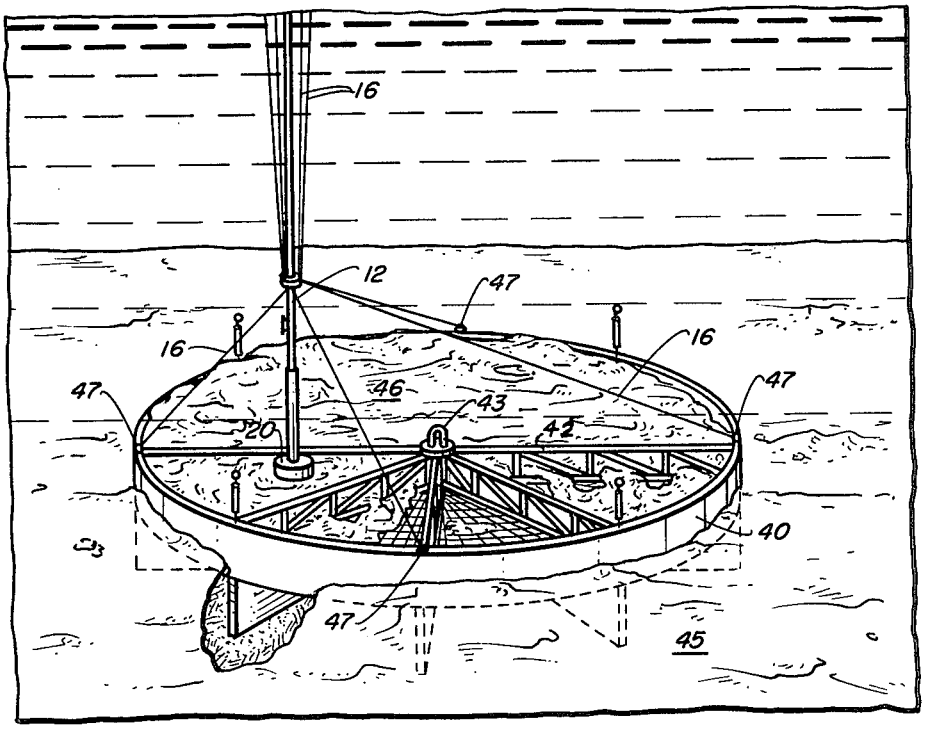
FIG. 4 illustrates a concrete placement method used to fabricate a multi-million pound capacity deadweight anchor, foundation, etc.

An alternative to lowering or free-falling a massive anchor is to combine pre-fabrication and in situ methods of this invention for such construction. A shell, such as shell 40 having reinforcement ribs or structural supports 42 shown in FIG. 4, can be free-fallen or lowered, from a hoist using a mooring connection 43, to the seafloor 45 using existing lift capability and then filled with a heavy material 46, such as concrete, aggregate, iron ore, etc., emplaced from the surface platform 10 by means of a discharge device 20 using a system like that shown in FIG. 1 and described above.

Concrete is a prime candidate for the heavy material 46. Concrete normally weighs about 150 pounds/cubic foot; suitable mixes can readily be produced in weights up to about 200 pounds/cubic foot by using iron ore aggregates. This compares with high density oil well slurries which weigh up to about 135 pounds/cubic foot when weighted with barite and to 160 pounds/cubic foot with magnetite. The shell 40, made of concrete or other materials, can be 100 feet or more in diameter. The hoist or mooring connection 43 and other hardware such as anchor points 47 and a transponder system or other location system can be built into shell 40 as needed.

Obviously, many modifications and variations of the present invention are possible in the light of the above teachings. It is therefore to be understood that within the scope of the appended claims the invention may be practiced otherwise than as specifically described.

What is claimed is:

1. A system for placing freshly mixed concrete on the seafloor at great depths, comprising:

a. a surface platform means;

b. a pipeline means extending from said surface platform means to the seafloor for transferring concrete mix from said surface platform means to the seafloor;

c. A discharge means at the seafloor end of said pipeline means;

d. said discharge means comprising:

a telescoping slip joint means which accommodates a portion of the seafloor end of said pipeline means and operates as a heave control for allowing vertical movement of the pipeline means therein while decoupling the discharge means from any vertical motion of said pipeline means;

an expansion chamber where velocity of concrete mix flowing through the pipeline means is reduced;

a discharge end, from which flowing concrete mix from said pipeline means is discharged;

a deflector means for directing downward flowing concrete mix to a horizontal flow, and which negates the vertical lift component of discharging concrete mix;

a means positioned about said discharge means for maintaining said discharge end at a desired fixed depth of burial in a mound of discharged concrete;

e. said discharge means operable for controlling the placement of concrete mix on the seafloor, and on objects and structures in the vicinity of the seafloor.

2. A system as in claim 1 wherein said surface platform means is a ship which grossly positions the surface end of said pipeline means.

3. A system as in claim 1 wherein means is provided for positioning the seafloor end of said pipeline means and said discharge means.

4. A system as in claim 3 wherein the position of the seafloor end of said pipeline means and discharge means is controlled by a wire guide system.

5. A system as in claim 4 wherein said wire guide system is controlled by pipeline positioning means on said surface platform.

6. A system as in claim 5 wherein wire guides are connected between seafloor anchor means and control means on said surface platform.

7. A system as in claim 1 wherein location of the seafloor end of said pipeline means is known by acoustic transponder means.

8. A system as in claim 1 wherein a fine positioning of the discharge means for placement thereof at the seafloor is by a position control means responsive to a subsea navigation means located in the vicinity of the seafloor end of said pipeline means.

9. A system as in claim 1 wherein said means for maintaining said discharge end of said discharge means at a desired fixed depth of burial in a mound of concrete is a float means.

10. A system as in claim 9 wherein said float means on said discharge means is a tank-like means positioned thereon at a desired location above the discharge end thereof, said tank-like means having means for being flooded with seawater, and being operable to ride on top of a mound of discharged concrete for maintaining the discharge end of said discharge means at a predetermined submergence depth in the concrete mound during placement operations.

11. A system as in claim 1 wherein the seafloor end of said pipeline means and said discharge means is positioned by control means over a pre-positioned hollow structure to be filled with concrete mix for fabrication of an underwater structure.

12. A system as in claim 11 wherein said control means is connected between said surface platform means and said hollow structure.

13. A system as in claim 1 wherein said expansion chamber has a downward increasing taper to prevent blockage by arching of aggregates in the concrete mix.

14. A system as in claim 1 wherein non-cementatious as well as cementatious materials can be placed in situ on the seafloor or in seafloor frameworks by means thereof for underwater structures, encasing hazardous materials and for anchoring purposes.

* * * * *